US007293670B2

(12) United States Patent
Waisanen

(10) Patent No.: US 7,293,670 B2
(45) Date of Patent: Nov. 13, 2007

(54) UPPER BLOCK

(75) Inventor: Steven K. Waisanen, Big Bend, WI (US)

(73) Assignee: MHE Technologies, Inc., Wilmington, DE (US)

( * ) Notice: Subject to any disclaimer, the term of this patent is extended or adjusted under 35 U.S.C. 154(b) by 328 days.

(21) Appl. No.: 10/967,382

(22) Filed: Oct. 18, 2004

(65) Prior Publication Data

US 2006/0065884 A1 Mar. 30, 2006

Related U.S. Application Data

(60) Provisional application No. 60/607,795, filed on Sep. 8, 2004.

(51) Int. Cl.
*B66C 13/06* (2006.01)

(52) U.S. Cl. ..... 212/272; 212/274

(58) Field of Classification Search ..... 212/272–274
See application file for complete search history.

(56) References Cited

U.S. PATENT DOCUMENTS 3,718,316 A * 2/1973 Larralde et al. ..... 254/277
3,746,182 A * 7/1973 Tax et al. ..... 212/274
3,786,935 A 1/1974 Vlazny et al.
3,791,628 A * 2/1974 Burns et al. ..... 254/277
3,899,083 A * 8/1975 Flessner et al. ..... 212/274
4,069,921 A 1/1978 Raugulis et al.
4,073,476 A 2/1978 Frank
4,268,013 A * 5/1981 Khan ..... 254/392
4,597,497 A 7/1986 Aberegg
4,662,786 A * 5/1987 Cherbonnier ..... 405/195.1
4,665,696 A * 5/1987 Rosman ..... 60/414
4,739,721 A * 4/1988 Peyre ..... 114/348
5,597,080 A * 1/1997 Culwell ..... 212/278
5,662,311 A 9/1997 Waedekin et al.
6,042,087 A 3/2000 Heinemann
6,578,825 B1 6/2003 Brandt
6,691,960 B2 2/2004 Metelski

* cited by examiner

*Primary Examiner*—Thomas J. Brahan
(74) *Attorney, Agent, or Firm*—Porter, Wright, Morris & Arthur, LLP

(57) ABSTRACT

A crane having an upper block, a lower block, a drum, and two ropes. The upper block includes an equalizer having a yoke to which the ropes are connected. The connections between the ropes and the yoke include load cells that measure the forces carried by each of the ropes. The upper block includes a fail-safe system that prevents failure of the upper block in overload conditions.

20 Claims, 4 Drawing Sheets

UPPER BLOCK

RELATED APPLICATIONS

This application claims the benefit of Provisional Patent Application Ser. No. 60/607,795, filed Sep. 8, 2004, the entire disclosure of which is incorporated by reference herein.

BACKGROUND OF THE INVENTION

The present invention relates to overhead cranes and particularly to upper blocks of overhead cranes. More particularly, the present invention relates to failure proof mechanisms for upper blocks of overhead cranes.

Conventional overhead cranes include an upper block that, in combination with a lower block and a drum, is used to raise or lower a hook or other lifting mechanism attached to the lower block. Often, conventional overhead cranes include failure proof mechanisms within the upper block to shut down the crane if an overload or uneven-load condition is present.

SUMMARY OF THE INVENTION

The present invention provides a crane having a drum, an upper block, a lower block, and at least two rope ends. The upper block includes an equalizer yoke pivotally mounted to a support wall of the upper block and having two load pins. Each rope end is coupled to one of the load pins, and the rope ends are substantially parallel to one another in a direction substantially perpendicular to a line running through the two load pins.

In another embodiment of the present invention, an equalizer is provided for a crane having a drum, a lower block, an upper block, and at least two rope ends. The equalizer comprises a support wall and an equalizer yoke pivotally coupled to the support wall. The equalizer yoke includes two load pins, each rope end being coupled to one of the load pins through a connection bracket. The connection bracket includes a frame substantially surrounding and movable relative to the load pin and an adjustment screw threaded through a top wall of the frame, the adjustment screw having an end in engagement with the load pin, wherein rotation of the adjustment screw moves the frame relative to the load pin.

Still another embodiment of the present invention provides an equalizer for a crane having a drum, a lower block, an upper block, and at least two rope ends. The equalizer comprises a support wall, an equalizer yoke, and a third pin. The equalizer yoke is pivotally coupled to the support wall and includes two load pins, each rope end being coupled to one of the load pins. The third pin is mounted to the equalizer yoke and extends through a tapered slot in the support wall, the third pin being wedged in a tapered end of the tapered slot when the yoke pivots.

In yet another embodiment of the present invention, an upper block for an overhead crane comprises a guide frame and a support wall movably positioned within the guide frame. A hydraulic cylinder is positioned between the guide frame and support wall. And, a pressure relief valve is connected to the hydraulic cylinder, the pressure relief valve opening if the fluid in the hydraulic cylinder exceeds a predetermined pressure value.

BRIEF DESCRIPTION OF THE DRAWINGS

The detailed description particularly refers to the accompanying figures in which.

DETAILED DESCRIPTION OF THE DRAWINGS

Figure 1:
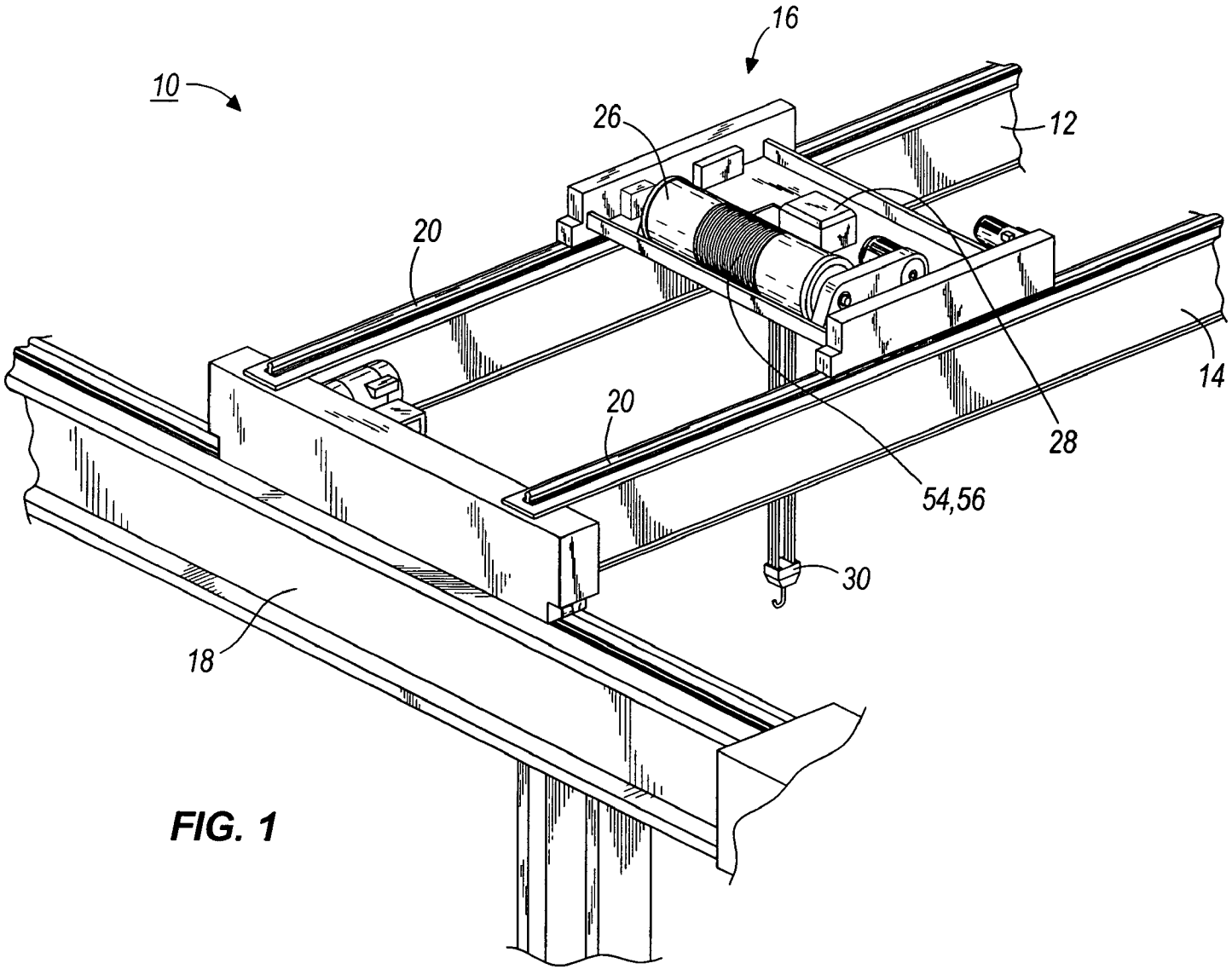
FIG. 1 is a perspective view of a crane including a trolley having an upper block according to the present invention.

Referring to FIG. 1, a crane 10 includes a trolley 16 that moves along girder rails 20 that sit atop a first girder 12 and a second girder 14. The first girder 12 and second girder 14 translate along a main support beam 18 on one end and an additional support beam (not shown) parallel to beam 18 on the other end. The trolley 16 includes a drum 26 around which is wrapped two wire ropes 54, 56. As the drum 26 rotates and winds up the wire ropes 54, 56, a lower block 30 is lifted, as will be readily apparent to those of skill in the art. As illustrated in FIG. 1, the lower block 30 includes a hook that can be used for lifting. However, the lower block 30 could include other configurations for lifting, as will also be readily apparent to those of skill in the art.

The translation of the trolley 16 along the first and second girders 12, 14 and the translation of the first and second girders 12, 14 along the main support beams 18 (only one of which is shown), allows the crane 10 to position the lower block 30 in virtually any location in a space in which the crane 10 is installed. The main support beam 18 is shown as a straight beam. As will be readily known to those of skill in the art, the main support beam 18 may alternatively be curved to match the inside wall contours of a round building. For example, a polar crane similar to crane 10, shown in FIG. 1, may be used in a nuclear containment building that is built in a round configuration, in which case the main support beam 18 will be shaped in a circle instead of a straight line.

As shown in FIG. 1, the wire ropes 54, 56 extend from the drum 26 to the lower block 30, which contains a plurality of sheaves (not shown) around which the wire ropes 54, 56 pass. From the lower block 30, the wire ropes 54, 56 extend to an upper block 28 that also contains a plurality of sheaves (not shown). After reeving back and forth between the lower block 30 and upper block 28, as will be readily understood by those of ordinary skill in the art, the wire ropes 54, 56 end at an equalizer 32, as best seen in FIG. 2, within the upper block 28.

Figure 3:
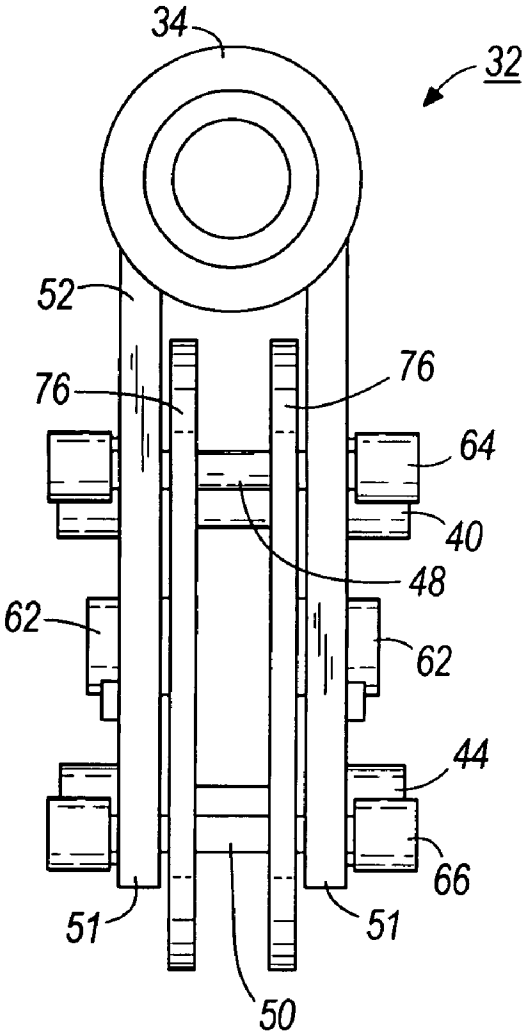
FIG. 3 is a side view of the equalizer of FIG. 2.
Figure 2:
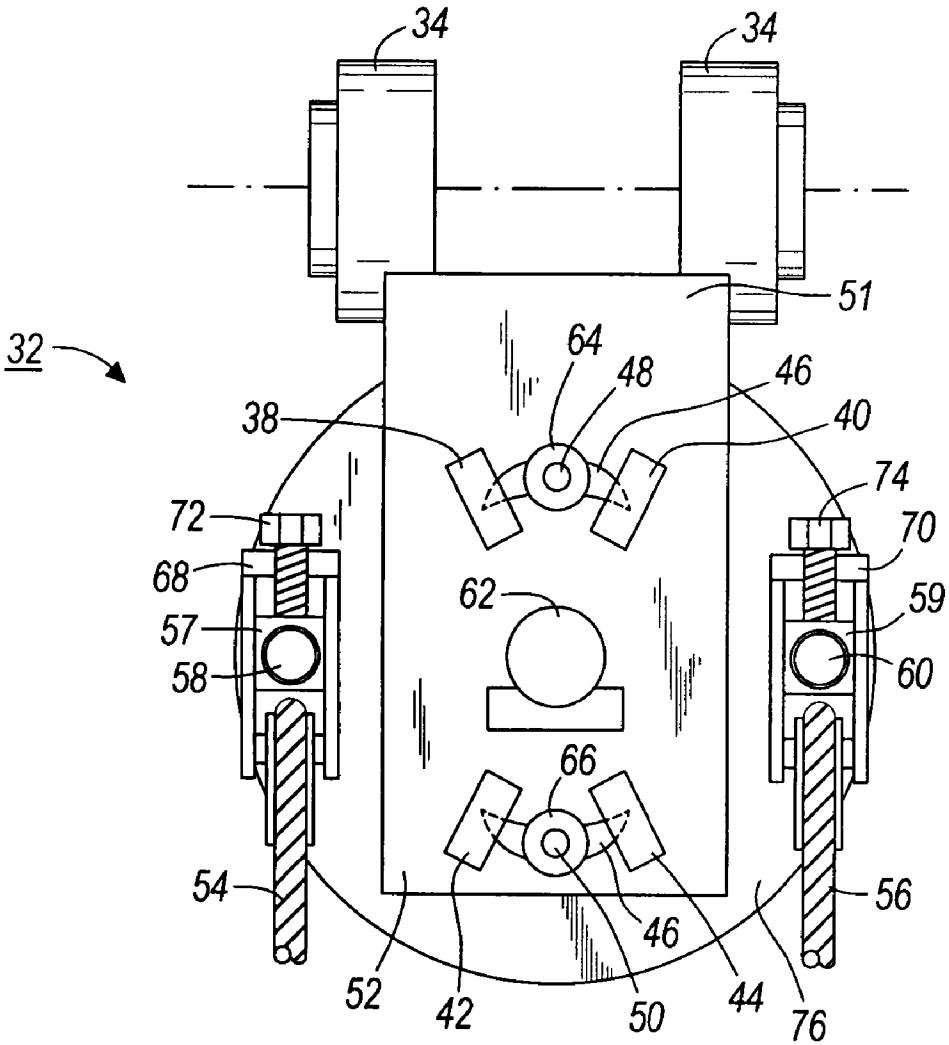
FIG. 2 is a front view of an equalizer, within the upper block of FIG. 1, having two wire ropes connected to connection brackets of the equalizer.

According to the present invention, as shown in FIG. 2, the first and second wire ropes 54, 56 are coupled to an equalizer yoke or sheave 76 that is pivotally supported in a saddle 52 by a main pin 62. The saddle 52 is pivotally supported within the upper block 28 through a sleeve support 34 that allows the entire equalizer 32 to swing within the upper block 28. The saddle 52 includes two support walls 51 between which the equalizer yoke 76 is sandwiched (see FIG. 3). The equalizer yoke 76 is illustrated as a round sheave, or wheel, in FIG. 2, but could be formed in any other shape (e.g., the hexagonal-shaped yoke 276, shown in FIG. 4 and discussed below) and pivotally supported by the saddle 52.

The first and second wire ropes 54, 56 are coupled to the equalizer sheave 76 with first and second connection brackets 68 and 70. The connection brackets 68, 70 are adjustable to correct for minor variations in the lengths of first and second wire ropes 54, 56 and to thereby even out the forces placed on the wire ropes 54, 56 by the bottom block 30. The connection brackets 68, 70 couple the wire ropes 54, 56 to first and second load cell bushings 57, 59 that include first and second load cells or load pins 58, 60, respectively, mounted to the equalizer sheave 76. The connection brackets 68, 70 are supported on the load cell bushings 57, 59 by first and second adjustment screws 72, 74. The adjustment screws 72, 74 are threaded through the top walls of the connection brackets 68, 70 and their ends engage the load cells or load pins 58, 60 through their respective load cell bushings 57, 59. Rotation of the adjustment screws 72, 74 causes the screws 72, 74 to push against the load cell bushings 57, 59 and respective load cells 58, 60. In this way, the adjustment brackets 68 and 70 move up and down relative to the load cell bushings 57, 59 as the adjustment screws 72, 74 are turned.

As mentioned, the first and second load cell bushings 57, 59 include first and second load cells or load pins 58, 60 that measure the load carried by the load cell bushings 57, 59. Before a load is lifted by the lower block 30 of the crane 10, the adjustment screws 72, 74 may be adjusted until the load cells 58, 60 register the same load reading, indicating that the load of the lower block 30 is equally shared by the first and second wire ropes 54, 56. Initially, when the only load carried by the wire ropes 54, 56 is the lower block 30 itself (i.e., the hook of the lower block 30 is not attached to any additional load), the adjustment screws 72, 74 are adjusted to take up minor discrepancies in the lengths of the wire ropes 54, 56 and to equalize the forces carried by the ropes 54, 56. When an additional load is attached to the lower block 30 the load cells 58, 60 indicate the additional load being lifted by the crane 10 and all of the load-bearing components of crane 10. As the drum 26 lifts the lower block 30 and any load attached thereto, the load cells 58, 60, in combination, measure the total load being lifted by the lower block 30 and, individually, the respective loads carried by each of the first and second wire ropes 54, 56.

By monitoring the readings of the load cells 58, 60, various load conditions can be monitored. For example, an overload condition on the entire crane system can be monitored, as well as a failure or overload of one of the first and second wire ropes 54, 56 (i.e., an uneven-load condition). If the crane 10 attempts to lift a load beyond its capacity, the total load registered by first and second load cells 58, 60 will register the excessively large load. A human or computer system can monitor the readings of the load cells 58, 60 and shut down the crane 10 if such an overload condition occurs.

Similarly, if, when lifting a load, one of the first and second wire ropes 54, 56 fails (i.e., breaks), the load cell 60 or 58 associated with the other (non-broken) wire rope 56, 54 will register all of the load carried by the lower block 30. The load cell 58 or 60 associated with the failed wire rope 54, 56 will register relatively no load. Again, a human or computer system monitoring the load cells 58, 60 can shut down the crane 10 if such a condition occurs. If one of the first and second wire ropes 54, 56 does not fail, but registers an excessively high reading relative to the other wire rope 56, 54 because of a misaligned or uneven load on the lower block 30 or other such condition, the crane 10 can similarly be shut down.

As mentioned, the wire ropes 54, 56 are coupled to the equalizer sheave 76 through connection brackets 68, 70. As also mentioned, the load is carried by first and second adjustment screws 72, 74 that engage the load cell bushings 57, 59. Therefore, the load is also carried by the threads of the adjustment screws 72, 74 and their threaded engagement with the top walls of the connection brackets 68, 70. If the threads of either adjustment screw 72, 74 fail, the corresponding connection bracket 68, 70 will fall until the top wall of the connection bracket 68, 70 hits the load cell bushing 57, 59. In this way, a failure of the threaded connection between either or both adjustment screws 72, 74 and their respective connection brackets 68, 70, will not result in one or both of the wire ropes 54, 56 disconnecting from the equalizer sheave 76. The bracket 68, 70 will fall a few inches and directly engage the load cell bushing 57, 59.

Relatively small variations in the loads carried by the first and second wire ropes 54, 56 will cause the equalizer sheave 76 to rotate, thereby equalizing the loads in the wire ropes 54, 56. If one of the first or second wire ropes 54, 56 breaks, the other wire rope 56, 54 will suddenly "feel" all of the load carried by the lower block 30. This will cause the equalizer sheave 76 to rotate more drastically about the main pin 62 that couples the equalizer sheave 76 to the saddle 52. The equalizer sheave 76 also includes upper and lower pins, 48 and 50 respectively, that move within respective saddle slots 46 in the saddle 52 when the equalizer sheave 76 rotates.

For example, if the second wire rope 56 were to break, all of the load on the lower block 30 will suddenly be carried by the first wire rope 54. This will cause the equalizer sheave 76 to rotate counter-clockwise within the saddle 52, thereby causing the upper pin 48 to move to the left in its tapered saddle slot 46 and the lower pin 50 to move to the right in its tapered saddle slot 46. Upon such rotation of the equalizer sheave 76, the upper and lower pins 48 and 50 move into tapered ends of the saddle slots 46 and prevent further rotation of the equalizer sheave 76. As the upper and lower pins 48 and 50 move into the tapered ends of the saddle slots 46, they progressively wedge themselves into the tapers of the saddle slots 46, thereby dampening the impulsive load placed on the first wire rope 54 when the second wire rope 56 breaks.

Figure 4:
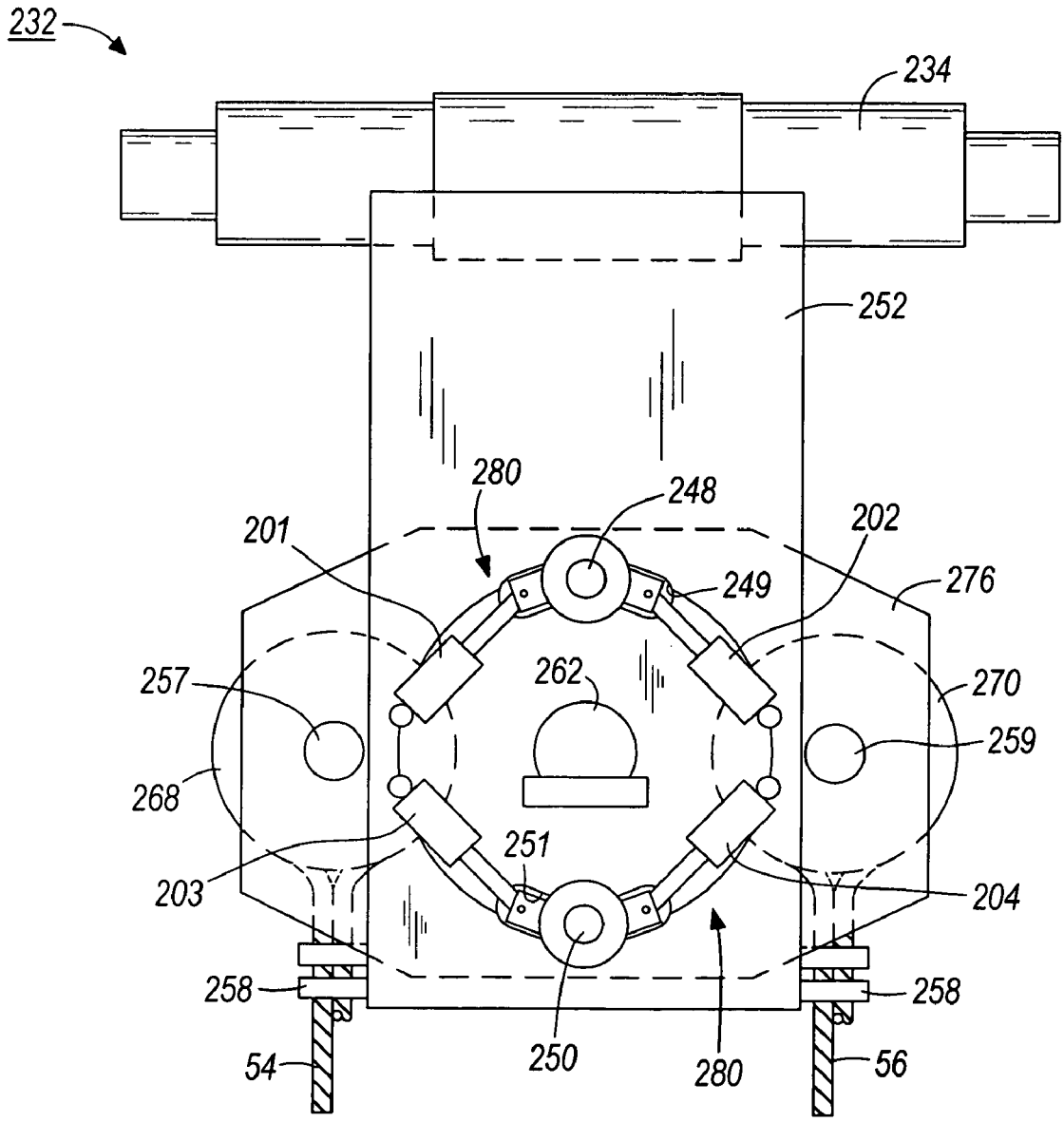
FIG. 4 is an alternative embodiment of the equalizer of FIG. 2.

To help dampen this impulsive force and prevent the first wire rope 54 from breaking under the nearly instantaneous additional force placed on it, the upper and lower pins 48 and 50 are surrounded by upper and lower rubber bumpers 64 and 66, respectively. The rubber bumpers 64 and 66 bump up against stop plates 38 and 44, respectively, which are connected to the saddle 54. By bumping up against the stop plates 38, 44, the rubber bumpers 64, 66 help absorb some of the impulsive force felt by the first wire rope 54 when the second wire rope 56 breaks. If the first wire rope 54 breaks instead of the second wire rope 56, as presented by way of example above, the equalizer sheave 76 will rotate clockwise within the saddle 52 and cause upper and lower rubber bumpers 64, 66 to respectively engage stop plates 40 and 42, both connected to the saddle 52. Mechanisms other than the rubber bumpers 64, 66 could be used to dampen the forces felt by the remaining rope 54, 56, when the other rope 56, 54 breaks. For example, and as will be discussed in further detail below, pneumatic cylinders, as shown in FIG. 4 could be used. Further, springs or other similar devices connected between the upper and lower pins 48, 50 and the saddle 52 could be used to dampen such forces.

In addition to dampening the forces felt by one rope 54, 56, if the other rope 56, 54 breaks, the upper and lower pins 48, 50 serve to secure the equalizer sheave 76 to the saddle 52 if the main pin 62 fails. If the main pin 62 breaks, the upper and lower pins 48, 50, will engage their respective tapered saddle slots 46 and hold the equalizer sheave 76 and the load carried by the crane 10, preventing them from falling.

Referring to FIG. 4, a second embodiment of an equalizer 232 is shown. The equalizer 232 includes a sleeve support 234, similar to the sleeve support 34 of FIGS. 2 and 3, which pivotally supports the equalizer 232 within the upper block 28 of the crane 10. The equalizer 232 includes an equalizer yoke 276 that is pivotally coupled to a saddle 252 that pivots with the sleeve support 234. The equalizer yoke 276 supports the first and second wire ropes 54, 56 and equalizes the forces carried by them by pivoting about a main pin 262 that connects the equalizer yoke 276 to the saddle 252.

The first and second wire ropes 54, 56 are coupled to the equalizer 276 by two load pins 257 and 259, respectively. The load pins 257 and 259 include load cells that measure the forces carried by each of the wire ropes 54 and 56. In this way, the load cells 257 and 259 function much the same way as the load cell bushings 57 and 59, and their associated load cells or load pins 58 and 60, of the equalizer 32 shown in FIGS. 2 and 3 and can be utilized to perform the same functionalities discussed with respect to the equalizer 32 above. The wire ropes 54, 56 are attached to the load pins 257, 259 by sheaves 268 and 270 that surround the load pins 257 and 259, respectively. Rope clamps 258 secure the wire ropes 54, 56 around the sheaves 268, 270. The sheaves 268, 270 rotate about the load pins 257, 259. In this way, regardless of the exact direction the wire ropes 54, 56 are pulling, the sheaves 268, 270 will rotate to keep the forces aligned with the load pins 257, 259. Similarly, the connection brackets 68, 70, shown in FIGS. 2 and 3, rotate about the load cells 58, 60 to keep the forces carried by the ropes 54, 56 aligned with the load cells 58, 60.

Like the equalizer 32, the equalizer 232 includes dampers 280 that serve to dampen an impulsive force felt by one of the wire ropes 54, 56 in the event the other of the wire ropes 56, 54 breaks. Unlike the equalizer 32, however, the equalizer 232 utilizes pneumatic cylinders 201, 202, 203, and 204 to dampen the impulsive force. Upper pin 248 and lower pin 250 are coupled to the equalizer yoke 276 and extend through upper slot 249 and lower slot 251, respectively, in the saddle 252. If one of the wire ropes 54, 56 breaks, the equalizer yoke 276 will quickly rotate, thereby moving the upper and lower pins 248, 250 within the upper and lower slots 249, 251. The pneumatic cylinders 201, 202, 203, and 204 will dampen this motion by providing resistance on the upper and lower pins 248, 250. All four pneumatic cylinders 201, 202, 203, and 204 work together to provide resistance on the upper and lower pins 248, 250 when the equalizer yoke 276 rotates.

As discussed above, both the equalizer 32 and the equalizer 232 include provisions for proofing against a failure of either or both of the wire ropes 54, 56 connected to the equalizer yokes 76, 276. The system shown in FIGS. 5 and 6 has an additional level of protection against overload of a crane, such as crane 10. Particularly, exceedingly high stresses placed on the saddles 52, 252 and sleeve supports 34, 234, shown in FIGS. 2, 3, and 4, will be prevented. If an excessively large load is placed on the lower block 30 of the crane 10 or the lower block 30 comes in contact with the upper block 28, the system shown in FIGS. 5 and 6 will relieve the general overall load condition placed on the upper block 28.

Any equalizer, including either of equalizers 32, 232, can be connected to a block plate or support wall 99 of the upper block 28. The block plate 99 could be used as the saddle 52 or 152 for the equalizers 32, 232, respectively. Or, the sleeve supports 34, 234 of the equalizers 32, 232 could be coupled to the block plate 99 of the upper block 28. In any case, whatever component of an equalizer is coupled to the block plate 99 of FIG. 5, the system illustrated in FIG. 5 serves to prevent a failure of the upper block 28 in the event the upper block 28 is placed under extreme or overload conditions.

Figure 5:
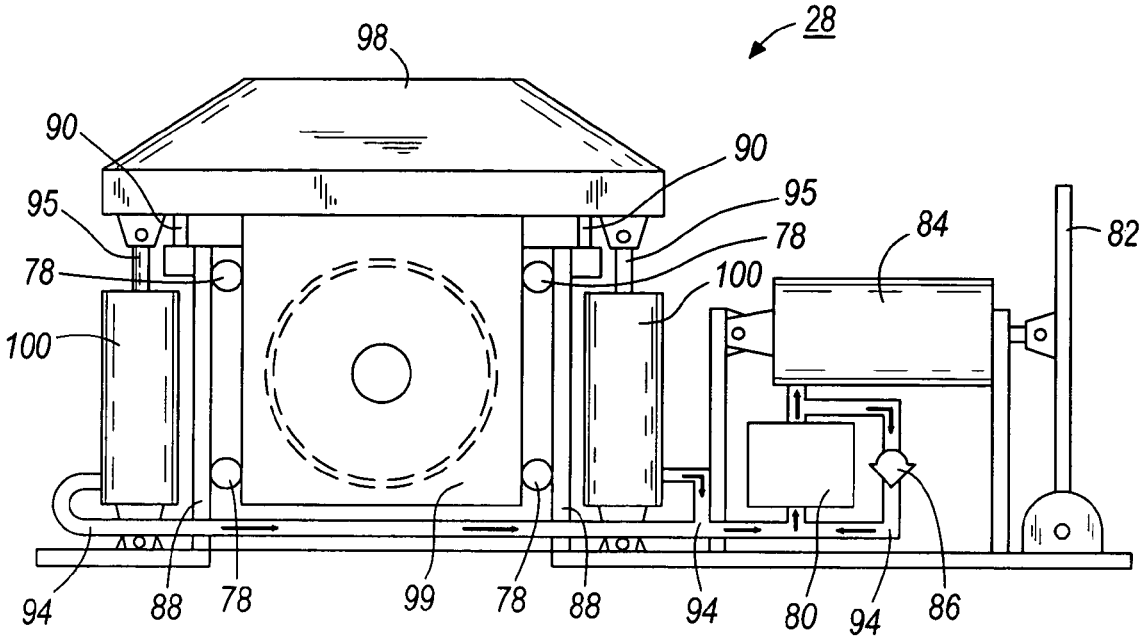
FIG. 5 is a side view of a schematic representation of the upper block of FIG. 1.
Figure 6:
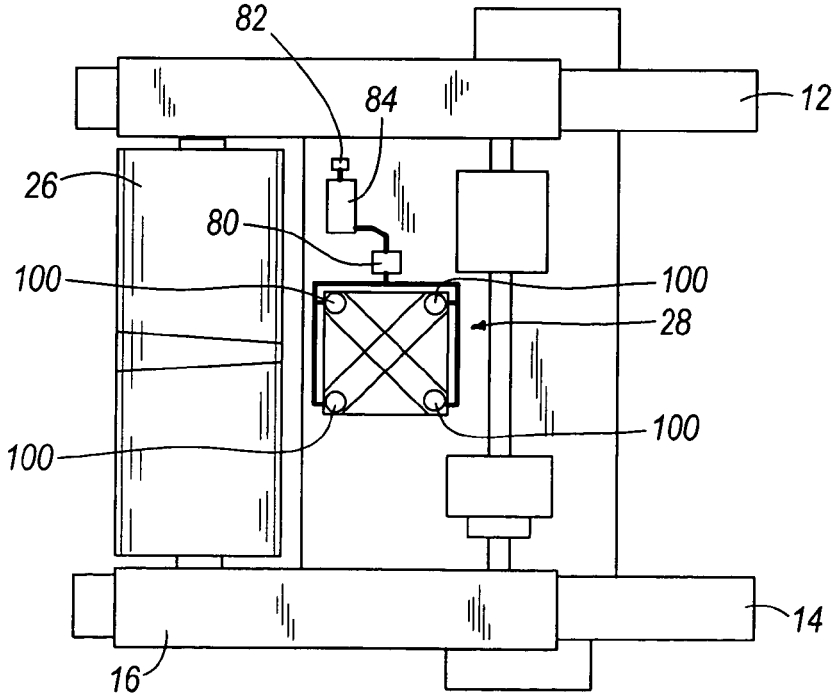
FIG. 6 is a top view of the trolley of FIG. 1, illustrating a schematic representation of the upper block.

Referring to FIGS. 5 and 6, the block plate 99 is movably supported within a guide frame 88. Guide rollers 78 positioned between block plate 99 and the guide frame 88 restrict the block plate 99 to only vertical movement within the guide frame 88. The block plate 99 and its cap 98 are supported on the guide frame 88 by hydraulic cylinders 100.

Any load carried by the crane 10, and thereby the block plate 99, translates into a fluid pressure within the hydraulic cylinders 100. Each of the hydraulic cylinders 100 is connected in parallel through hydraulic lines 94. In this way, the pressure in each of the hydraulic cylinders 100 is always the same. The hydraulic lines 94 all run to a pressure relief valve 80. The pressure relief valve 80 is preset to hold up to a particular pressure value and to release only when that pressure value is exceeded. If loads placed on the block plate 99 are within an acceptable range, the pressure relief valve 80 remains closed. Because the pressure relief valve 80 remains closed, the fluid pressure within the hydraulic cylinders 100 is maintained. Therefore, the force exerted by the hydraulic cylinders 100 on the block plate 99 is maintained. The hydraulic cylinders 100 include linkages 95 that connect the hydraulic cylinders 100 to the cap 98 of the block plate 99.

If the load on the upper block 28, and particularly the load on the block plate 99, exceeds a predetermined value, the fluid pressure in the hydraulic cylinders 100 and the hydraulic lines 94 will correspondingly exceed a preset pressure value and cause the pressure relief valve 80 to open. Opening of the pressure relief valve 80 will cause fluid from the cylinders 100 to drain into an accumulator cylinder 84. This allows the system to slowly relieve the overload force placed on the upper block 28 before a component such as the block plate 99 fails.

Relieving the fluid pressure in the hydraulic cylinders 100 by draining hydraulic fluid into the accumulator cylinder 84 causes the cap 98 of the block plate 99 to move down within the guide frame 88. When the block plate 99 has moved down a certain extent, contact switches 90 coupled to the guide frame 88 are tripped by the cap 98 of the block plate 99. The tripping of switches 90 causes the crane control system to shut down the drum 26 and stop the function of the crane 10 until the overload condition can be relieved. Once the overload condition is relieved, a lever 82 coupled to the accumulator cylinder 84 is depressed to force the accumulated fluid in the accumulator cylinder 84 through a one-way check valve 86, through the hydraulic lines 94, and back into the hydraulic cylinders 100, thereby resetting the system.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

The invention claimed is:

1. An overhead crane comprising:

a rotatable drum;

a lower block;

an upper block having a support wall;

two wire ropes having ends secured to the upper block and extending from the upper block to the lower block and from the lower block to the upper block so that the lower block is lifted when the drum rotates to wind the wire ropes around the drum and so that the lower block is lowered when the drum rotates to unwind the wire ropes from the drum;

a guide frame;

wherein the support wall is movably positioned within the guide frame and restricted to only vertical movement within the guide frame;

at least one hydraulic cylinder vertically positioned between the guide frame and support wall so that the support wall is supported on the guide frame by the at least one hydraulic cylinder and any load carried by the crane translates into fluid pressure within the at least one hydraulic cylinder; and a pressure relief valve connected to the hydraulic cylinder, the pressure relief valve opening if the fluid in the hydraulic cylinder exceeds a predetermined pressure value to relieve pressure within the hydraulic cylinder and cause the support wall to move down within the guide frame.

2. The overhead of claim 1, further comprising an accumulator cylinder into which the fluid from the hydraulic cylinder drains when the pressure relief valve opens.

3. The overhead crane of claim 2 further comprising a lever operably coupled to the accumulator cylinder to force accumulated fluid in the accumulator cylinder back into the at least one hydraulic cylinder.

4. The overhead crane of claim 3, further comprising a one-way check valve located between the at least one hydraulic cylinder an the accumulator cylinder and in parallel with the relief valve so that accumulated fluid in the accumulator cylinder can be forced back into the at least one hydraulic cylinder.

5. The overhead crane of claim 1, wherein there are at least two of the hydraulic cylinders connected in parallel, and the hydraulic cylinders are connected by a hydraulic line to the pressure relief valve.

6. The overhead crane of claim 1, further comprising a movable trolley which carries the drum and the guide frame.

7. The overhead crane of claim 6, wherein the drum is located adjacent the guide frame and above the lower block.

8. The overhead crane of claim 1, wherein the block plate has a cap located above the guide frame and the at least one hydraulic cylinder is vertically positioned between the guide frame and the cap.

9. The overhead crane of claim 8, wherein there are four of the hydraulic cylinders connected in parallel, the hydraulic cylinders are connected by a hydraulic line to the pressure relief valve, and the four hydraulic cylinders positioned at four corners of the cap.

10. The overhead crane of claim 1, wherein guide rollers are positioned between the support wall and the guide frame for vertical movement of the support wall relative to the guide frame.

11. The overhead crane of claim 1, further comprising at least one switch on the guide frame which causes the drum to stop rotating when the support wall moves down a predetermined extent relative to the guide frame.

12. An overhead crane comprising:

a rotatable drum;

a lower block;

an upper block having a support wall;

two wire ropes having ends secured to the upper block and extending from the upper block to the lower block and from the lower block to the upper block so that the lower block is lifted when the drum rotates to wind the wire ropes around the drum and so that the lower block is lowered when the drum rotates to unwind the wire ropes from the drum;

a guide frame;

wherein the support wall is movably positioned within the guide frame and restricted to only vertical movement within the guide frame;

a movable trolley which carries the drum and the guide frame;

wherein the drum is located adjacent the guide frame on the trolley and above the lower block;

a plurality of hydraulic cylinders vertically positioned between the guide frame and the support wall so that the support wall is supported by the plurality of hydraulic cylinders and any load carried by the crane translates into fluid pressure within the plurality of hydraulic cylinders;

a pressure relief valve connected to the plurality of hydraulic cylinders; and wherein the pressure relief valve opens if fluid in the hydraulic cylinders exceeds a predetermined pressure value to relieve pressure within the hydraulic cylinders and cause the support wall to move down within the guide frame.

13. The overhead of claim 12, further comprising an accumulator cylinder into which the fluid from the hydraulic cylinders drains when the pressure relief valve opens.

14. The overhead crane of claim 13, further comprising a lever operably coupled to the accumulator cylinder to force accumulated fluid in the accumulator cylinder back into the at least one hydraulic cylinder.

15. The overhead crane of claim 14, further comprising a one-way check valve located between the at least one hydraulic cylinder an the accumulator cylinder and in parallel with the relief valve so that accumulated fluid in the accumulator cylinder can be forced back into the at least one hydraulic cylinder.

16. The overhead crane of claim 12, wherein plurality of hydraulic cylinders are connected in parallel, and the hydraulic cylinders are connected in parallel, and the hydraulic cylinders are connected by a hydraulic line to the pressure relief valve.

17. The overhead crane of claim 12, wherein the block plate has a cap located above the guide frame and the plurality of hydraulic cylinders is vertically positioned between the guide frame and the cap.

18. The overhead crane of claim 17, wherein there are four of the hydraulic cylinders connected in parallel, the hydraulic cylinders are connected by a hydraulic line to the pressure relief valve, and the four hydraulic cylinders positioned at four corners of the cap.

19. The overhead crane of claim 12, wherein guide rollers are positioned between the support wall and the guide frame for vertical movement of the support wall relative to the guide frame.

20. The overhead crane of claim 12, further comprising at least one switch on the guide frame which causes the drum to stop rotating when the support wall moves down within the guide frame a predetermined extent relative to the guide frame.

* * * * *